US005247894A

United States Patent [19]

Haisfield et al.

[11] Patent Number: 5,247,894

[45] Date of Patent: Sep. 28, 1993

[54] PRO-SUBMARINE MOBILE DECOY

[75] Inventors: Rudolph M. Haisfield, Silver Spring; Homer D. Musselman, Hillcrest Heights, both of Md.

[73] Assignee: The United States of America as represented by the Secretary of the Navy, Washington, D.C.

[21] Appl. No.: 176,877

[22] Filed: Feb. 28, 1962

[51] Int. Cl.[5] ..... F42B 19/00; H04K 3/00

[52] U.S. Cl. ..... 114/20.1; 367/1; 434/10

[58] Field of Search ..... 114/20, 20.1, 20.2, 114/20.3; 340/3; 333/29, 30 M; 346/74, 74.2, 74.3, 74.4, 74.5, 74.6, 74.7; 367/1; 434/6, 10

[56] References Cited

U.S. PATENT DOCUMENTS 2,887,671 5/1959 Frankel et al. ..... 367/1

*Primary Examiner*—Stephen C. Bentley

*Attorney, Agent, or Firm*—Thomas E. McDonnell

[57] ABSTRACT

An inexpensive decoy which simulates the evasive tactics of a submarine under attack for pulse echo type search systems and which can be ejected through the flare tube of a submarine.

5 Claims, 1 Drawing Sheet

PRO-SUBMARINE MOBILE DECOY

The invention described herein may be manufactured and used by or for the Government of the United States of America for governmental purposes without the payment of any royalties thereon or therefor.

The present invention relates to countermeasures for use against weapons systems which employ sonar searching systems. More particularly the invention relates to a decoy which simulates a submarine.

The use of helicopters and similar vehicles in conjunction with sonar search equipment has considerably reduced the time a submarine can evade, once it has detected the presence of a search sonar. If it is determined that evasive tactics are not successful, the next logical step for the craft under attack is to try to jam or at least supply as much false data to the search sonar as is possible. This, however, can result in providing the search craft with an even more positive contact.

The use of a decoy device offers a measure of protection in this regard. The decoy is placed in the water and either the decoy or vessel under attack moves to provide separation before or during the time that false information is transmitted by the decoy. Thus even if the attack is successful it is the decoy and not the vessel itself which is destroyed.

Most decoys are designed for use against passive sonar systems by providing appropriate noises to similate a submarine underway. There is a need for a decoy which will respond to a pulse echo type system, as well, supplying information which will be confusing even to a fairly seasoned operator, who has been trained to spot decoy responses.

It is an object of the present invention, therefore, to provide an inexpensive decoy which will similate the evasive tactics of a submarine under attack for pulse echo type search systems.

A further object of the invention is to provide a decoy of the type described above which can be ejected through the flare tube of a submarine.

These and other objects of the present invention will be best understood with reference to the accompanying drawings in conjunction with the following specification wherein.

Figures 1, 2, 3, 4:
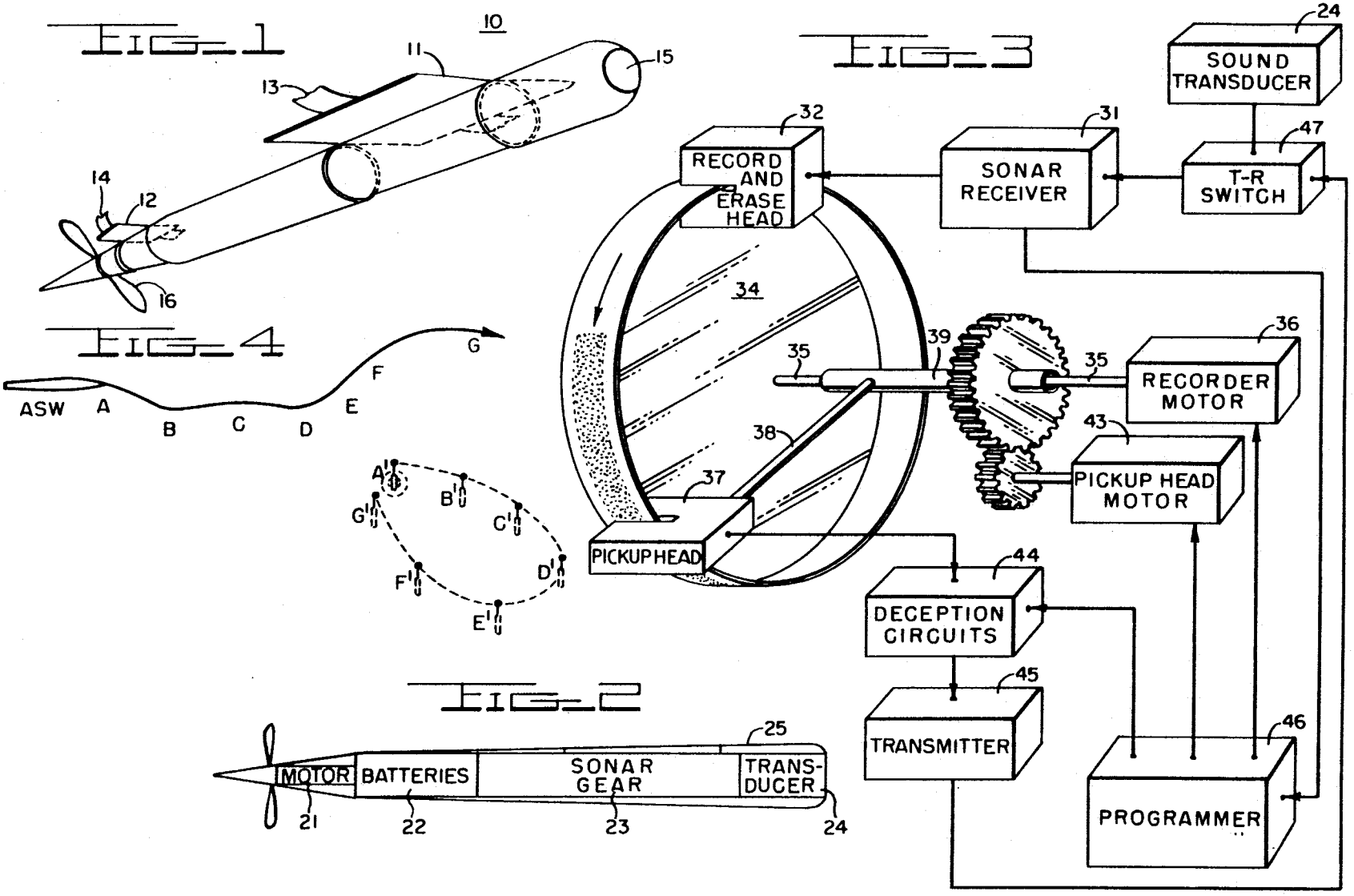
FIG. 1 shows a view of the entire decoy.
FIG. 2 shows the general construction of decoy's interior.
FIG. 3 shows the sonar gear enclosed in the decoy.
FIG. 4 shows diagrammatically how the decoy appears to a sonar operator.

Referring to FIG. 1 a typical form of the decoy is shown. The overall shape of the outer housing 10 resembles a torpedo, but the dimensions are much smaller. A typical model would be 3" in diameter and a little over 39" long. This structure is easily ejected through the flare tube of a submarine.

Attached to the housing 10 along its length are forward and rear gliding planes 11 and 12. These planes are provided with a downwardly concave curative so as to provide lift as the decoy, which has a density slightly heavier than water, moves through the water. These planes are stiff enough to support the weight of the decoy in water, but sufficiently resilient to be wrapped around the housing. The housing diameter may be reduced, if necessary, over the areas covered by these planes, so that outer diameter of the housing with planes wrapped therearound is substantially uniform over most of its length. The planes are fastened in their wrapped positions by means of water soluble tapes 13 and 14.

The housing has openings at either end so that equipment within the decoy can be coupled to the medium outside. The aperture 15 in the nose is provided for an electrical sound transducer. The aperture at the opposite end is for passage of a shaft to drive the propeller 16.

FIG. 2 shows the general structure of the interior of the decoy. An electric propulsion motor 21 is positioned at the rear to turn the motor shaft. Ahead of this are mounted the batteries 22 which power the motor and other electrical units. The forward portion of housing contains the sonar gear 23 with an electrical transducer 24 mounted at the very front, filling the aperture 15 shown in FIG. 1. The housing is split into parts as at 25 to provide access to the interior for inserting these units. Any suitable means, such as threaded portions, may be used to join the parts of the housing.

The sonar gear is shown more specifically in FIG. 3. In general this gear comprises a loop circuit which begins and terminates at the transducer. Appropriate controls vary the propagation of signals passing around the loop. The transducer is of the reciprocal type and acts both as a hydrophone applying incident signals to the loop input and as a driver for generating fluid waves in response to signals from the output end of the loop.

Beginning at the input end of the loop the elements which comprise the loop will be described in order. The first element is a sonar receiver 31, which amplifies and, if necessary, changes the frequency by heterodyne action or otherwise prepares the signal for magnetic storage in accordance with principles well understood in the art. The receiver output is connected to the input of a magnetic recording head 32 through which passes an endless recording tape 33. The recording head also includes an erase circuit which removes any information previously stored on the tape before it passes under the recording magnet in the recording head.

The signal is returned to electrical form at the pickup head 37 for transmission over the remainder of the loop. The pickup head is coupled to the input of a system of deception circuits. These circuits attenuate, filter, or alter the frequency of the loop signal, so that it will correspond to an echo from a typical target. For example, one such deception circuit is disclosed in the U.S. Pat. No. 2,887,671, issued to Frankel, May 19, 1959. These circuits also may include noise generators with suitable mixing circuits to simulate target generated noises.

The remainder of the loop is completed by a transmitter 45 and a T-R switch 47. The transmitter is coupled to the deception circuits and raises the power level of the signal therefrom sufficiently to drive transducer 24. The T-R switch response to a signal from the transmitter, connecting the latter to the transducer and decoupling the sonar receiver. Such arrangements are commonplace in the sonar art and need no further discussion here.

The characteristics of the signals circulating around the loop are controlled by a programmer 46. The programmer may consist of one or more voltage sources of varying magnitude and cam operated switches driven by a timing motor to connect these sources to output terminals in a preselected time sequence. Similar programmers are found on automatic clothes-washers, dishwashers and the like. The programmer may be started manually before the decoy is ejected, or may be energized by a self holding relay coupled to the sonar receiver to start in response to the incident sonar signal. Elements controlled by the programmer include the tape 33, the pickup head and the deception circuit.

Referring more particularly to the mechanical portions of the system, the tape is supported at one edge on a rigid tape disc 34. An axle 35 joined at one end to the tape disc and at the opposite end to the tape motor 36 supports the disc and tape for rotation. An arrow has been placed on the tape to denote the direction of rotation.

The pickup head rotates about a first end of an arm 38, being firmly attached to the opposite end of this arm. The first end of the arm is attached to a sleeve 39 which rotates freely on the axle 35. A gear 40 is also attached to the sleeve and engages a pinion 41. The pinion is attached to the shaft 42 of a pickup head motor 43.

The function of the programmer is to connect the motors 36 and 43 and the noise generators in the deception circuits to a power source when operation of these devices is desired. The pickup head motor is reversible and can be connected in proper polarity to move the pickup head in either direction. Both the pickup head motor and the tape motor run at varying speeds, depending on the magnitude of the voltage source to which they are connected.

FIG. 4 shows a diagram of the apparent position of the buoy as it is tracked by a passing ASW craft. Note that each of the positions $B^1$, $C^1$, etc., is on a straight line with the coincident position B,C,etc., of the ASW craft passing through the real position $A^1$ of the buoy. To provide the apparent positions shown the programmer merely connected the pickup motor to rotate the pickup head with the tape, then reversed the polarity to return the head to its initial position near the recording head. The buoy, if it is assumed to be a submarine, appears to have circled and is now attacking the ASW craft. If the buoy is silenced when the apparent position is again at the real buoy position $A^1$, the ASW craft must assume that it has lost contact at a very critical moment, a fact that should absorb all of its attention while the real submarine is escaping.

The structure of the elements themselves is fairly conventional. The sonar receiver 31, the deception circuits, the transmitter and the T-R switch are preferably transistorized to save size and weight and to economize on power. Conventional record and erase equipment are used in head 32. The same is true of the tape 33 and the pickup head 37. Disc 34 may be either plastic or metal, but is preferably non-magnetic.

All elements except the tape disc, the pickup head, and elements firmly attached thereto are attached to the housing by means of brackets or the like (not shown). Each unit may include its own source of power or share the batteries 22 provided for the propulsion motor 21 shown in FIG. 2. An overall chassis (not shown) may be provided so that the sonar gear can be combined into a single unit to be inserted in the housing 10.

The housing itself may be made of steel. The gliding planes 11 and 12 also are preferably steel, tempered to provide the needed resilience. This material will also provide magnetic shielding for the recorder.

The decoy can be made otherwise than as heretofore specifically described. The deception circuits may be omitted, if desired. The propulsion motor and associated elements may also be omitted, and the decoy buoyancy adjusted to make it to glide downward or upward upon release. Instead of rotating, a rectilinear tape transport and pickup head movement can be employed.

Obviously many modifications and variations of the present invention are possible in the light of the above teachings. It is therefore to be understood that within the scope of the appended claims the invention may be practiced otherwise than as specifically described.

What is claimed is:

1. A decoy comprising an elongated, closed, cylindrical housing, a sonar receiver mounted within said housing, storage means to record and hold sonar signals picked up by said receiver, a transmitter means within said housing for regenerating said sonar signals at a higher power level, variable timing means interconnecting said storage means and transmitter for applying said sonar signals to the transmitter input only after a predetermined time delay, and control means connected to said timing means for varying said time delay in accordance with a preselected program.

2. The decoy according to claim 1 wherein said housing includes a section of reduced outer diameter and an external resilient, substantially planar gliding plane attached to said housing at said section, said gliding plane being bent around said section, and a water soluble fastening means engaging said housing and gliding plane to hold said plane in said bent position.

3. The decoy according to claim 1 wherein said storage means includes a tape recorder.

4. The decoy according to claim 3 wherein said timing means includes a movable pickup head mounted on said tape recorder and motor means for moving said pickup relative to the recording head of said tape recorder.

5. The decoy according to claim 3 including a noise source mounted within said housing and means connected to the input of said transmitter for combining signals from said noise source with the signals from said storage means.

* * * * *